US010755620B2

(12) United States Patent
Matsuishi

(10) Patent No.: US 10,755,620 B2
(45) Date of Patent: Aug. 25, 2020

(54) TONE CORRECTION DATA PREPARATION DEVICE, TONE CORRECTION DEVICE, ELECTRONIC APPARATUS, AND TONE CORRECTION DATA PREPARATION METHOD

(71) Applicant: SHARP KABUSHIKI KAISHA, Sakai, Osaka (JP)

(72) Inventor: Takuya Matsuishi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/381,855

(22) Filed: Apr. 11, 2019

(65) Prior Publication Data

US 2019/0318679 A1 Oct. 17, 2019

(30) Foreign Application Priority Data

Apr. 13, 2018 (JP) ..... 2018-077776

(51) Int. Cl.
*G09G 3/20* (2006.01)
*G09G 3/36* (2006.01)

(52) U.S. Cl.
CPC ..... *G09G 3/2003* (2013.01); *G09G 3/2007* (2013.01); *G09G 3/3607* (2013.01); *G09G 2320/0242* (2013.01); *G09G 2320/0666* (2013.01)

(58) Field of Classification Search
CPC .. G09G 3/2003; G09G 3/3607; G09G 3/2007; G09G 3/36; G09G 2320/0242; G09G 2320/0666; G09G 2320/0693; G09G 2320/0673; G09G 2360/145; G09G 2340/06
See application file for complete search history.

(56) References Cited

U.S. PATENT DOCUMENTS

2006/0071940 A1* 4/2006 Ouchi ..... G09G 3/2092 345/600
2012/0013635 A1* 1/2012 Beeman ..... G09G 3/2003 345/590

FOREIGN PATENT DOCUMENTS

JP 2015-133606 A 7/2015

* cited by examiner

*Primary Examiner* — Alexander Eisen
*Assistant Examiner* — Kebede T Teshome
(74) *Attorney, Agent, or Firm* — ScienBiziP, P.C.

(57) ABSTRACT

The driver calculates a white gamma curve based on a deviation of a tone (including a maximum tone) of white displayed on a liquid crystal display panel (LCD panel) with respect to a target tone value and on a measured gamma value at arbitrary tones excluding a maximum tone in a white gamma characteristic of the LCD panel. The driver calculates three primary gamma curves by applying, to the white gamma curve, a relation obtained by comparing a gamma curve of white of a reference display panel with gamma curves of respective red, green, and blue. The driver corrects a white balance of display data based on the three primary gamma curves and expected output values of respective three primary colors calculated based on highest tone values of three primary colors of the reference display panel and of white of the LCD panel.

7 Claims, 12 Drawing Sheets

TONE CORRECTION DATA PREPARATION DEVICE, TONE CORRECTION DEVICE, ELECTRONIC APPARATUS, AND TONE CORRECTION DATA PREPARATION METHOD

This Nonprovisional application claims priority under 35 U.S.C. § 119 on Patent Application No. 2018-077776 filed in Japan on Apr. 13, 2018, the entire contents of which is hereby incorporated by reference.

TECHNICAL FIELD

The present invention relates to a tone correction data preparation device for preparing tone correction data for correcting a tone value of display data to be supplied to a display device.

BACKGROUND ART

Display devices such as liquid crystal display devices have individual differences in display characteristic depending on unevenness of chromaticity of white light emitting diodes (LEDs) used in backlights. Therefore, in a case where all pixels display white, unevenness of displayed white occurs between display devices. Such unevenness of displayed white can be reduced by white balance adjustment.

For example, Patent Literature 1 discloses a technique in which the number of optical measurements of a displayed image which need to be carried out for white balance adjustment is reduced to shorten a time required for the white balance adjustment. Specifically, tones are selected that allow X, Y, Z stimulus value characteristics with respect to a tone to be substantially reproduced in a case where a spline function is generated at a minimum number of measurement points. For example, optical measurements need to be carried out at a maximum value, a minimum value, an intermediate value, and a tone value around a singular region found in a characteristic of a Z stimulus value.

CITATION LIST

Patent Literature

[Patent Literature 1]
Japanese Patent Application Publication, Tokukai, No. 2015-133606 (Publication Date: Jul. 23, 2015)

SUMMARY OF INVENTION

Technical Problem

In the white balance adjustment, measurement points are obtained in a curve representing a tone characteristic, and the measurement points thus obtained are applied to the spline function. However, in practice, a shape of the curve cannot be predicted, and therefore shapes of the curve between measurement points need to be predicted by obtaining a greater number of measurement points.

An object of an aspect of the present invention is to achieve white balance adjustment on the basis of a smaller number of measurement points.

Solution to Problem

In order to attain the object, a tone correction data preparation device in accordance with an aspect of the present invention includes: a white gamma curve calculating section which calculates a white gamma curve based on a deviation of a tone of white displayed on a display panel with respect to a target tone value and on a measured gamma value, the tone including a maximum tone and being measured at one or more measurement points, the measured gamma value being measured at one or more measurement points at an arbitrary tone excluding a maximum tone in a white gamma characteristic of the display panel; a three primary gamma curve calculating section which calculates three primary gamma curves of respective red, green, and blue by applying, to the white gamma curve, a relation obtained by comparing a gamma curve of white of a reference display panel having an ideal gamma characteristic with gamma curves of respective red, green, and blue of the reference display panel; and a conversion value calculating section which calculates, based on expected output values of respective three primary colors and the three primary gamma curves, a conversion value for converting inputted display data into corrected display data in which a white balance has been corrected, the expected output values being calculated by the conversion value calculating section based on highest tone values of respective three primary colors of the reference display panel and on a highest tone value of white of the display panel.

Advantageous Effects of Invention

According to an aspect of the present invention, the white balance adjustment can be achieved based on a smaller number of measurement points.

DESCRIPTION OF EMBODIMENTS

[Embodiment 1]

The following description will discuss Embodiment 1 of the present invention with reference to FIGS. 1 through 10.

(Schematic Configuration of Liquid Crystal Display Device 100)

Figure 1:
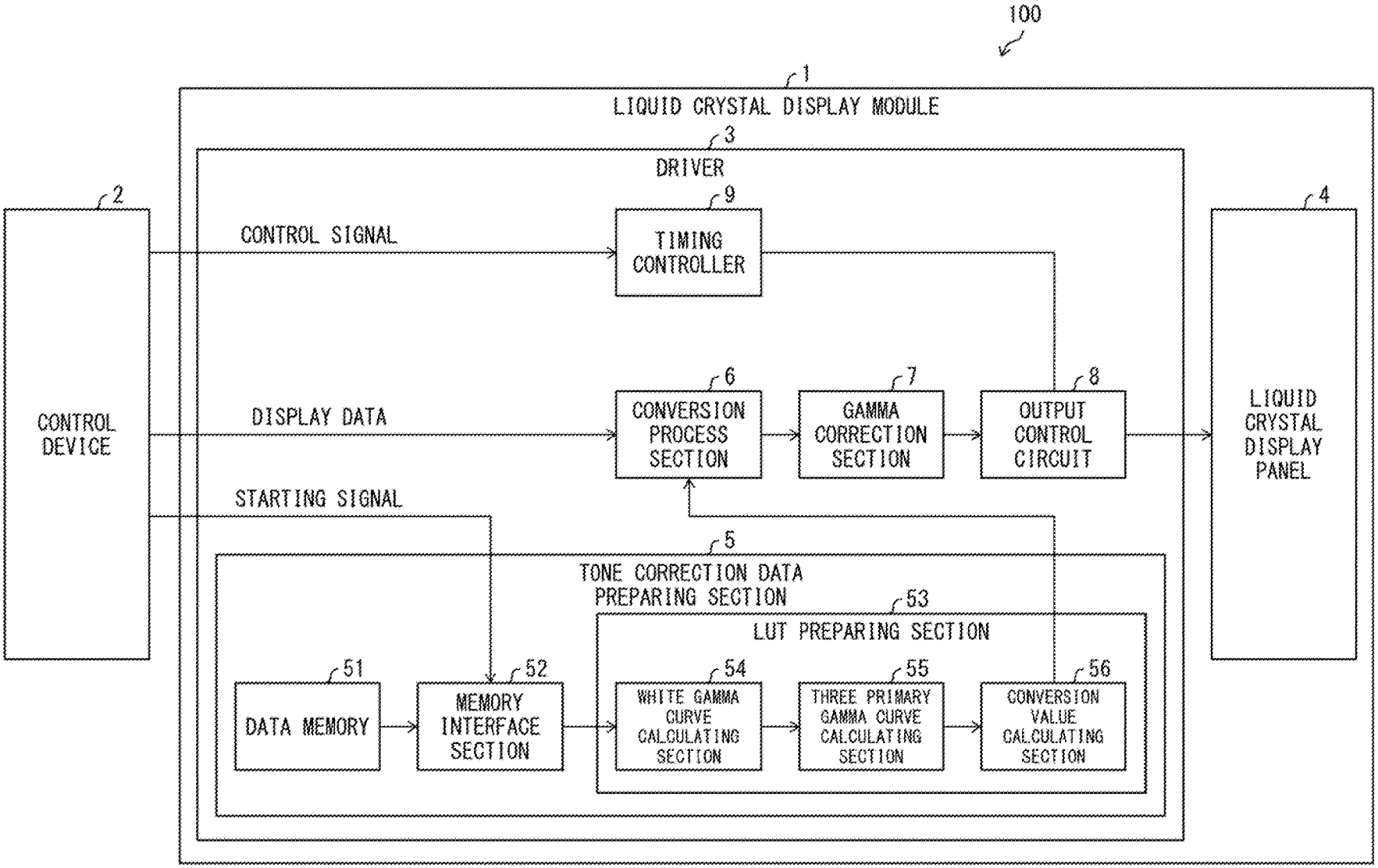
FIG. 1 is a block diagram illustrating a configuration of a liquid crystal display device in accordance with Embodiment 1 of the present invention.

FIG. 1 is a block diagram illustrating a configuration of a liquid crystal display device 100 in accordance with Embodiment 1.

As illustrated in FIG. 1, the liquid crystal display device 100 includes a liquid crystal display module 1 and a control device 2. The liquid crystal display module 1 is a part serving as a display unit in the liquid crystal display device 100, and includes a driver 3 (tone correction device, display driving circuit) and a liquid crystal display panel 4 (display panel). The liquid crystal display module 1 can further include a backlight (not illustrated).

The liquid crystal display panel 4 is configured by filling a space between two glass substrates with liquid crystal and providing pixel circuits on one of the glass substrates in a matrix manner so as to constitute pixels.

The driver 3 is a circuit that drives the pixel circuits of the liquid crystal display panel 4 and supplies display data to each of the pixel circuits at a predetermined point of time. The driver 3 is configured by an integrated circuit (IC) and is mounted directly on the glass substrate of the liquid crystal display panel 4 as a bare chip by a chip on glass (COG) technique. The driver 3 can be provided independently of the liquid crystal display panel 4 and is connected to an end of the liquid crystal display panel 4 by, for example, tape automated bonding (TAB).

(Configuration of Driver 3)

The driver 3 includes a tone correction data preparing section 5 (tone correction data preparation device), a conversion process section 6, a gamma correction section 7, an output control circuit 8, and a timing controller 9.

The tone correction data preparing section 5 prepares tone correction data that is necessary for white balance correction.

The conversion process section 6 is a look-up table (LUT) that is constituted based on the tone correction data prepared by the tone correction data preparing section 5. The conversion process section 6 carries out a process of converting display data, which has been inputted from the control device 2, into corrected display data in which a white balance has been corrected.

The gamma correction section 7 corrects display data, which has been outputted from the conversion process section 6, based on a predetermined gamma characteristic.

The output control circuit 8 is a circuit which sequentially outputs, row by row, pieces of display data, which have been inputted from the gamma correction section 7, to respective pixel circuits of the liquid crystal display panel 4 at predetermined points of time.

The timing controller 9 is a circuit that generates a control signal for providing a point of time to the output control circuit 8. As the control signal, a clock, a start pulse, a sampling signal, or the like is generated. The start pulse is a pulse that is used as a reference for generating a selection pulse for selecting pixel circuits of each row. The sampling signal is a signal for sampling display data row by row.

Functions of the tone correction data preparing section 5, the conversion process section 6, and the gamma correction section 7 can be achieved by executing specific programs by a central processing unit (CPU) that may be provided in the driver 3. The tone correction data preparing section 5, the conversion process section 6, and the gamma correction section 7 can be configured by a processor (e.g., digital signal processor (DSP)) which is capable of carrying out digital signal processing at a high speed.

Alternatively, the tone correction data preparing section 5, the conversion process section 6, and the gamma correction section 7 carry out specific arithmetic processing, and therefore can be configured by a dedicated application specific IC (ASIC) which is configured by a logic circuit for carrying out the specific arithmetic processing. The tone correction data preparing section 5, the conversion process section 6, and the gamma correction section 7 can be configured by a programmable logic device (PLD) (e.g., a field programmable gate array (FPGA)) which is programmable and into which a memory element can be incorporated.

The control device 2 is a device that controls a display operation of the liquid crystal display module 1 and is configured by an IC. The control device 2 has a function to output externally inputted display data at a predetermined point of time, a function to generate a control signal to be supplied to the timing controller 9, a function to supply a starting signal to the tone correction data preparing section 5, and the like. The control device 2 outputs a starting signal when a power source of an apparatus on which the liquid crystal display device 100 is mounted is turned on.

(Detailed Configuration of Tone Correction Data Preparing Section 5)

Figure 2A:
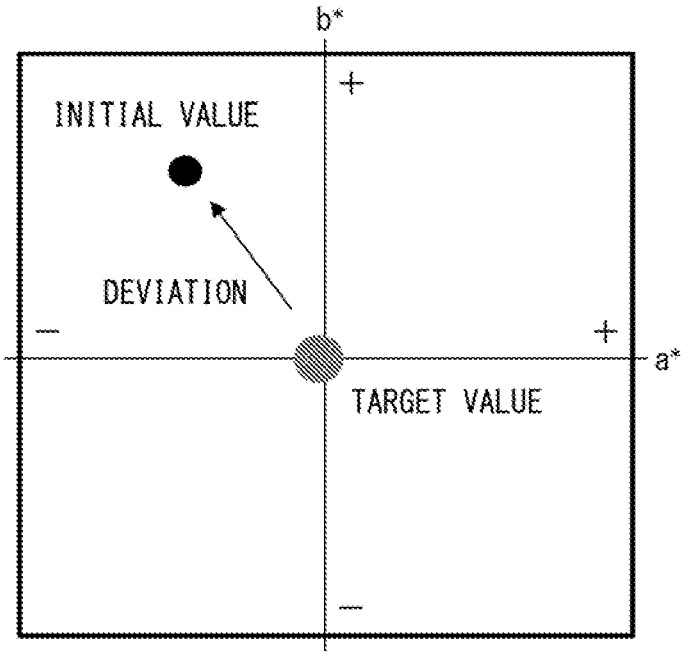
FIG. 2A is a view showing data of a tone measured when a liquid crystal display panel is displaying white and showing a deviation of an initial value (measured value) with respect to a target value.
Figure 2B:
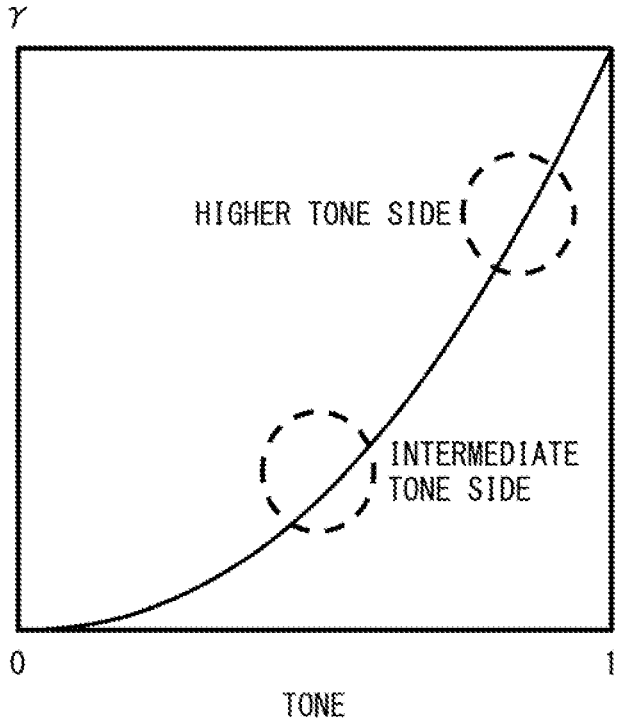
FIG. 2B is a view showing data of a tone measured when a liquid crystal display panel is displaying white and showing γ values with respect to tone values at a plurality of points.

Next, the following description will discuss the tone correction data preparing section 5 in detail. FIG. 2A and FIG. 2B are views showing data of a tone measured when the liquid crystal display panel 4 is displaying white. Specifically, FIG. 2A is a view showing a deviation of an initial value (measured value) with respect to a target value, and FIG. 2B is a view showing γ values with respect to tone values at a plurality of points.

In FIG. 2A, the initial value in a state in which white is monochromatically displayed on the liquid crystal display panel 4 is represented by an L*a*b* coordinate system. In FIG. 2A, a horizontal axis represents a* (chromaticness index), and a vertical axis represents b* (chromaticness index). Moreover, in FIG. 2A, an axis which is perpendicular to the horizontal axis and the vertical axis and passes through the origin represents L* (lightness). A range of coordinates of L* is from 0 (black) to 100 (white), and ranges of coordinates of a* and b* vary depending on an original color space that is converted into an Lab color space.

FIG. 2B shows a characteristic of a γ value with respect to a tone value of an original display characteristic (plain characteristic) of the liquid crystal display panel 4 in a state in which tone correction has not been carried out. A horizontal axis of the characteristic represents tone values whose maximum value is represented by "1", and a vertical axis represents values of γ.

The tone correction data preparing section 5 includes a data memory 51 (storage section), a memory interface section 52 (data obtaining section), and an LUT preparing section 53.

The data memory 51 is a memory for storing two types of eigenvalues indicating the display characteristic of the liquid crystal display panel 4 that is to be subjected to tone correction. The eigenvalues can be (i) a deviation of a tone (including maximum tone) of white measured at one or more measurement points on the liquid crystal display panel 4 with respect to a target tone value and (ii) a measured gamma value measured at one or more measurement points at an arbitrary tone excluding the maximum tone in the white gamma characteristic of the liquid crystal display panel 4. In a case where displayed tones are 255 tones, white (W) which represents the target value has tone values of red (R)=255, green (G)=255, and blue (B)=255.

As shown in FIG. 2A, a deviation of an initial value which is a measured value (e.g., L*=100, a*=a1 (a1>0), b*=b1 (b1>0)) with respect to the target value (L*=100, a*=0, b*=0) is represented by L*=0, a*=a1, b*=b1. Alternatively, the target value is not limited to one (1) point and, for example, a white color having tone values of R=245, G=245, and B=245 can be set as another target value. Then, a deviation with respect to this target value is stored in the data memory 51 as a deviation at another measurement point.

In a case where only one (1) measured gamma value is used, a measurement point on a higher tone side is used. In a case where two or more measured gamma values are used, at least one (1) measurement point on a higher tone side and one (1) measurement point on an intermediate tone side are used.

The memory interface section 52 is a circuit that reads out an eigenvalue from the data memory 51. The memory interface section 52 reads out an eigenvalue from the data memory 51 based on a starting signal supplied from the control device 2, and outputs the eigenvalue to the LUT preparing section 53.

The LUT preparing section 53 prepares a LUT based on an eigenvalue. The LUT preparing section 53 includes a white gamma curve calculating section 54, a three primary gamma curve calculating section 55, and a conversion value calculating section 56.

The white gamma curve calculating section 54 calculates a white gamma curve, which is a gamma curve of white, based on a deviation and a measured gamma value. The deviation is a deviation of a tone (including a maximum tone) of white measured at one or more measurement points on the liquid crystal display panel 4 with respect to a target tone value. The measured gamma value is measured at one or more measurement points at an arbitrary tone excluding the maximum tone in the white gamma characteristic of the liquid crystal display panel 4.

The three primary gamma curve calculating section 55 calculates three primary gamma curves of R, G, and B by applying, to the white gamma curve, a relation obtained by comparing a gamma characteristic of W of a reference display panel having an ideal gamma characteristic with gamma curves of R, G, and B of the reference display panel.

The conversion value calculating section 56 calculates expected output values of respective three primary colors by carrying out a predetermined arithmetical operation based on highest tone values of respective three primary colors of the reference display panel and on a highest tone value of white of the liquid crystal display panel 4. Here, the expected output values are ratios of tones of respective R, G, and B for a synthesis value of R, G, and B to become a target chromaticity. In addition, the conversion value calculating section 56 calculates, based on the calculated expected output values and the three primary gamma curves, a conversion value as tone correction data for converting display data (inputted display data), which has been inputted from the control device 2, into corrected display data whose white balance has been corrected.

(Operation of Driver 3)

The following description will discuss an operation of the driver 3 which is configured as described above.

Figure 3:
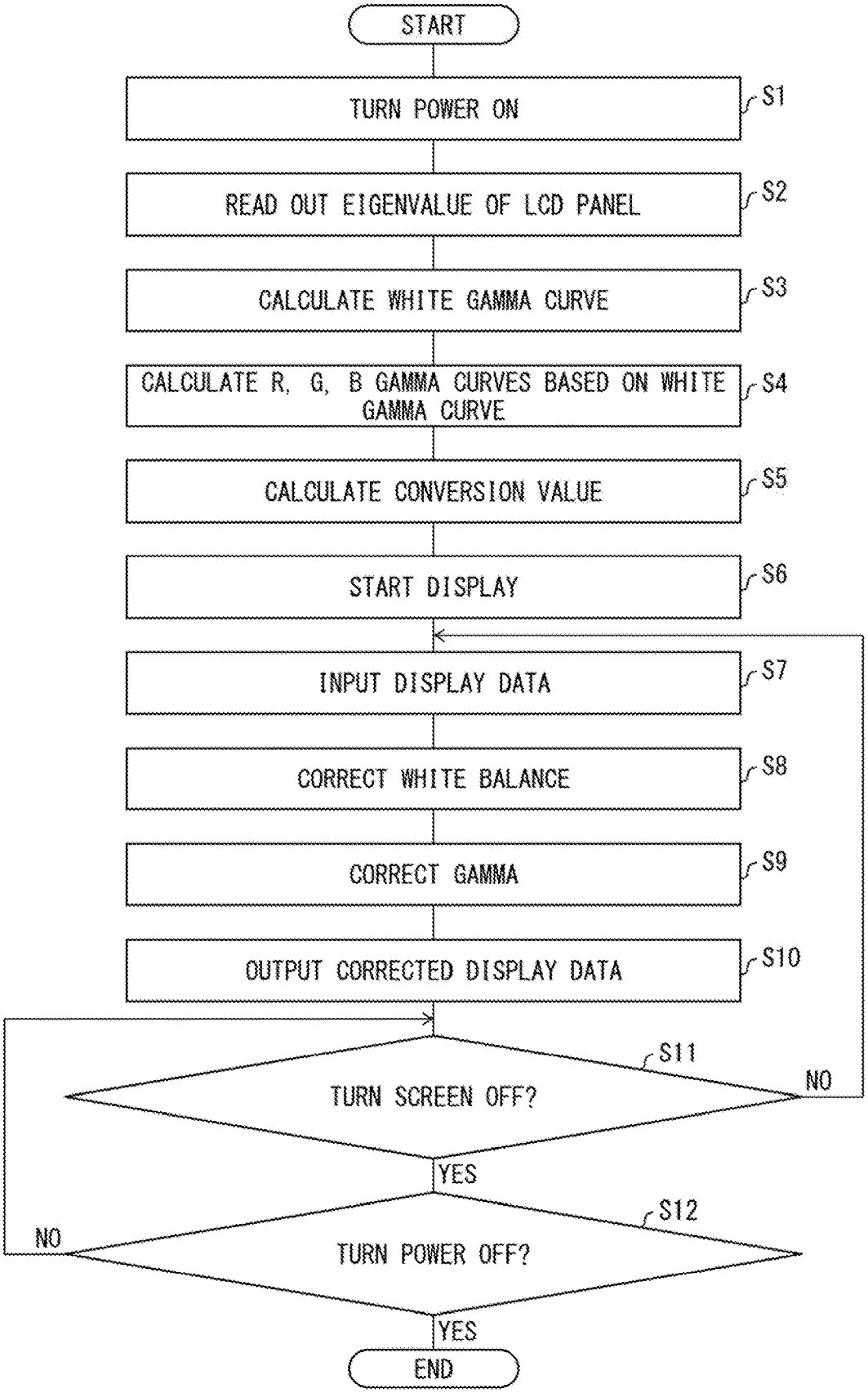
FIG. 3 is a flowchart showing procedures of tone correction data preparation and tone correction operation which are carried out by the liquid crystal display device.

FIG. 3 is a flowchart showing procedures of tone correction data preparation (tone correction data preparation method) and tone correction operation which are carried out by the driver 3 of the liquid crystal display device 100.

As shown in FIG. 3, first, when the power source of the apparatus on which the liquid crystal display device 100 is mounted is turned on (step S1), the control device 2 outputs a starting signal. The memory interface section 52 reads out an eigenvalue from the data memory 51 based on the starting signal (step S2). Then, the white gamma curve calculating section 54 of the LUT preparing section 53 calculates a white gamma curve based on the eigenvalue (step S3).

Based on the white gamma curve, the three primary gamma curve calculating section 55 calculates gamma curves of respective R, G, and B (three primary gamma curves) (step S4). The conversion value calculating section 56 calculates a conversion value for the conversion process section 6 to convert display data. Specifically, the conversion value calculating section 56 calculates the conversion value based on (i) the expected output values of respective three primary colors which have been calculated from the highest tone values of respective three primary colors of the reference display panel and the highest tone value of white of the liquid crystal display panel 4 and on (ii) the three primary gamma curves (step S5). The conversion value calculating section 56 holds the calculated conversion value in a form of LUT corresponding to each piece of inputted display data.

In a case where the liquid crystal display device 100 has started a display operation in this state (step S6), the control device 2 inputs display data to the conversion process section 6 (step S7). The conversion process section 6 corrects a white balance of the inputted display data by outputting a conversion value as corrected display data to the inputted display data (step S8).

After that, the gamma correction section 7 carries out predetermined gamma correction with respect to the corrected display data outputted from the conversion process section 6 (step S9). Then, the output control circuit 8 outputs, to the liquid crystal display panel 4, the output display data which has been subjected to the gamma correction by the gamma correction section 7 (step S10).

Further, the control device 2 determines whether or not to turn off the screen in response to an external instruction (step S11). In a case where the control device 2 has determined not to turn off the screen (NO), the control device 2 returns the process to the step S7. In a case where the control device 2 has determined in the step S11 to turn off the screen (YES), the control device 2 determines whether or not to turn off the power source in response to an external instruction (step S12). In a case where the control device 2 has determined not to turn off the power source (NO), the control device 2 returns the process to the step S11. In a case where the control device 2 has determined in the step S12 to turn off the power source (YES), the control device 2 ends the process.

(Calculation of White Gamma Curve)

Figure 4:
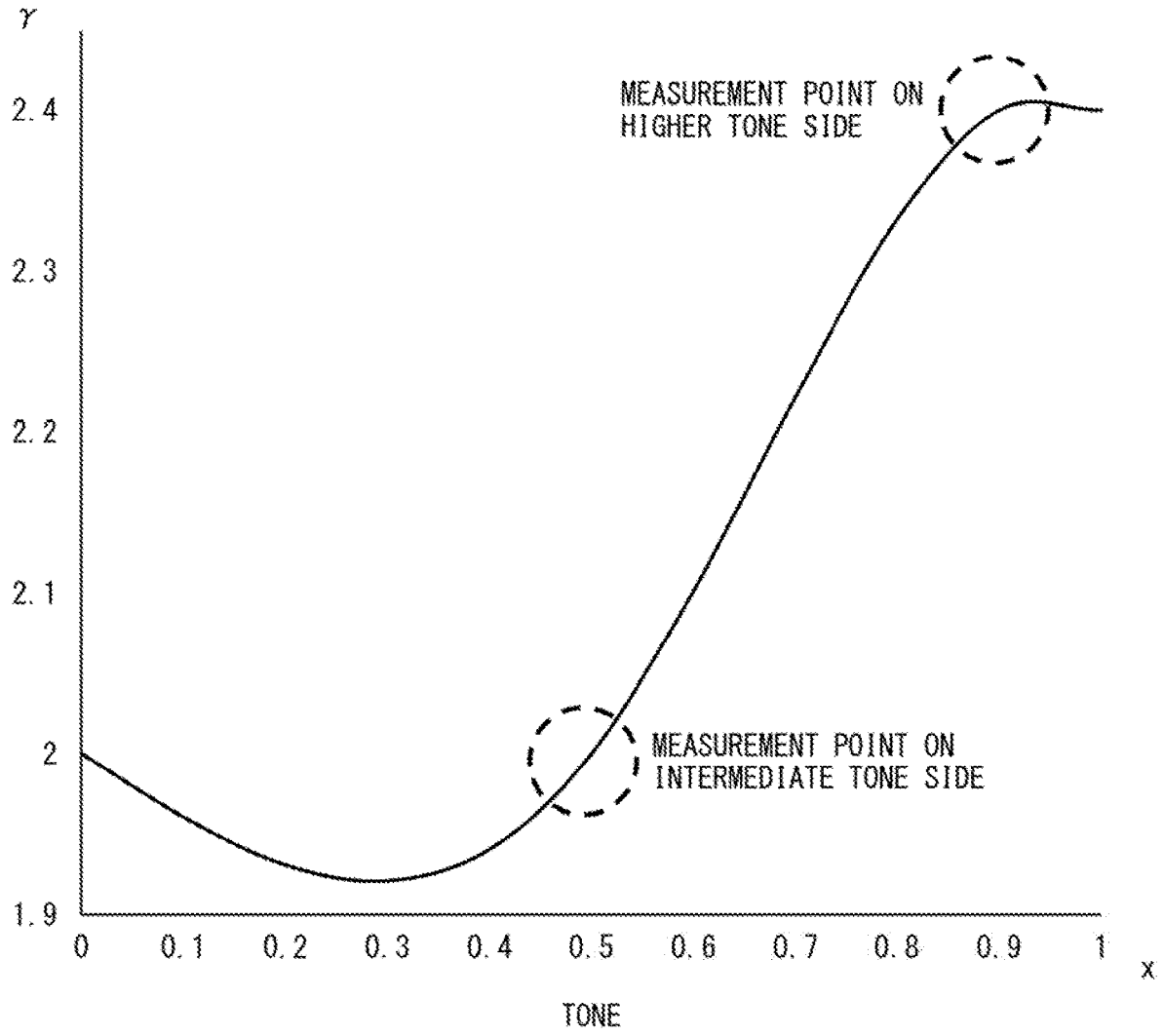
FIG. 4 is a view for explaining an interpolation that is carried out based on measured values of γ values with respect to tone values at a plurality of points.
Figure 5:
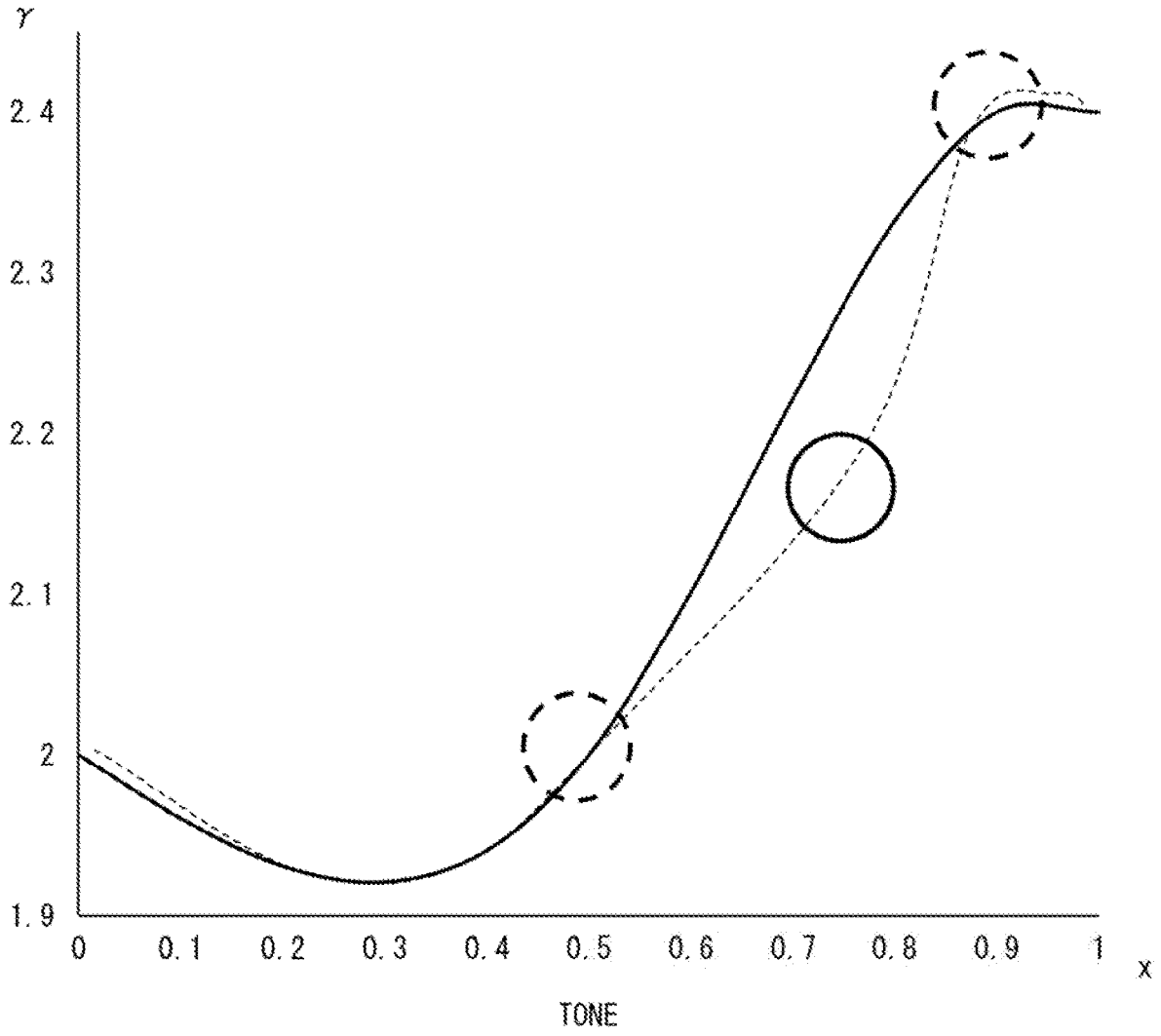
FIG. 5 is a view for explaining another interpolation that is carried out based on measured values of γ values with respect to tone values at a plurality of points.
Figure 6:
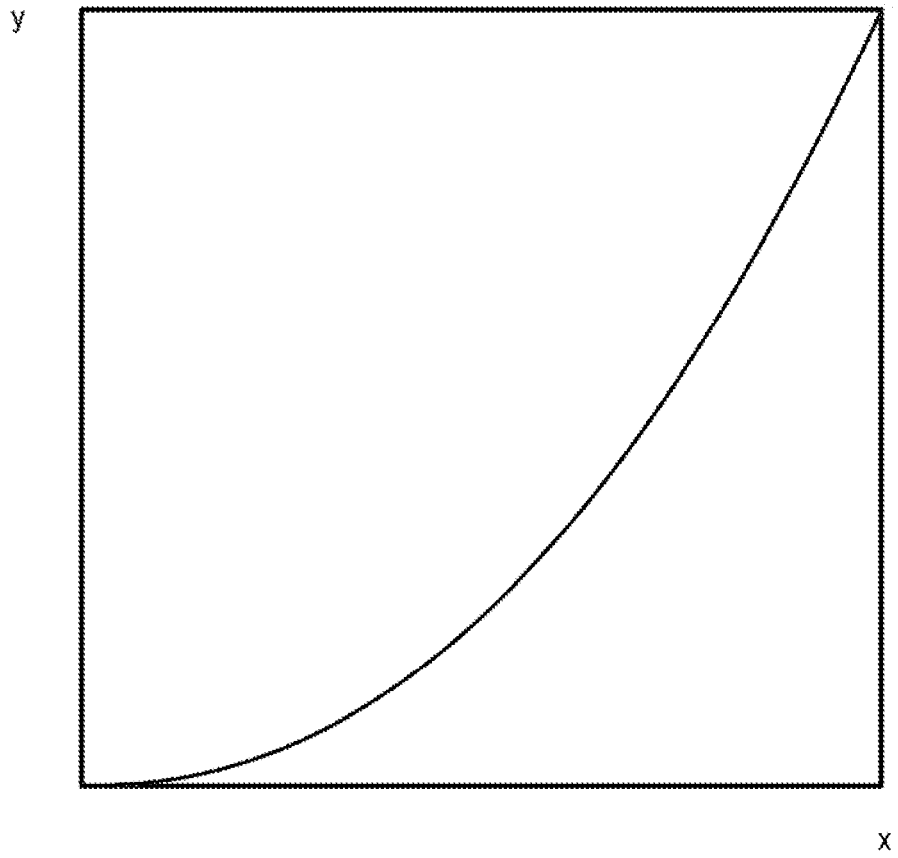
FIG. 6 is a view showing a white gamma curve that has been calculated based on the measured values.

Here, the calculation of a white gamma curve which is carried out in the step S3 (white gamma curve calculation process) will be described in detail. FIG. 4 is a view for explaining an interpolation that is carried out based on measured values of γ values with respect to tone values at a plurality of points. FIG. 5 is a view for explaining another interpolation carried out based on measured values of γ values with respect to tone values at a plurality of points. FIG. 6 is a view showing a white gamma curve calculated based on the measured values.

The white gamma curve calculating section 54 calculates top coordinates on the white gamma curve based on a deviation in the calculation of the white gamma curve. The top coordinates represented by tone values of maximum tone values of R, G, and B on the white gamma curve. The white gamma curve calculating section 54 calculates the top coordinates of the white gamma curve by adding a deviation to an initial value so as to eliminate the deviation of the initial value with respect to the target value. The white gamma curve calculating section 54 also calculates a correction value with respect to the target value using a deviation with respect to an auxiliary target value at a tone (e.g., (R,G,B)=(245,245,245)) which is slightly lower than the top coordinates of the target value (R,G,B)=(255,255,255). Thus, by calculating the correction value with use of the ancillary target value, it is possible to more accurately predict a form of the white gamma curve in the vicinity of the top coordinates.

The white gamma curve calculating section 54 also calculates a part other than the top coordinates on the white gamma curve based on measured gamma values in the calculation of the white gamma curve.

In a case where one (1) measured gamma value (which is a measured gamma value on the higher tone side) is used, the white gamma curve calculating section 54 can predict an inclination angle of the white gamma curve based on a magnitude of the measured gamma value. For example, in a case where the measured gamma value is small, the white gamma curve as a whole is a gentle curve with a small inclination angle. In a case where the measured gamma value is large, the white gamma curve as a whole is a sharp curve with a large inclination angle. Thus, the white gamma curve calculating section 54 calculates a white gamma curve based on one (1) measured gamma value in accordance with a predetermined rule (e.g., data indicating patterns of white gamma curve corresponding to measured gamma values stored in advance in the driver 3).

In a case where one (1) measured gamma value is used, a measured gamma value at the intermediate tone can be used. However, it is preferable to use a measured gamma value on the higher tone side (e.g., tone values of R, G, and B are 232, 232, and 232). In information equipment such as a mobile phone, although a photograph or the like containing a large amount of intermediate tones may be displayed, images containing a large amount of higher tones (e.g., email, browser) are often displayed. Moreover, a deviation of tone with respect to a target value is more noticeable in brighter colors (in other words, brighter colors are easier to correct). Therefore, by using the measured gamma value on the higher tone side, it is possible to carry out correction in which the corrected deviation is hardly noticeable.

In a case where at least two measured gamma values (i.e., a measured gamma value on the higher tone side and a measured gamma value on the intermediate tone side) are used, the white gamma curve calculating section 54 calculates a white gamma curve by carrying out an interpolation calculation based on these measured gamma values. An interpolation method used by the white gamma curve calculating section 54 in the interpolation calculation includes a spline interpolation, a linear interpolation, and the like.

In a case where the spline interpolation is used, it is possible to further increase accuracy. For example, in a case of a gamma curve in which a γ value on the higher tone side is small and a γ value at the intermediate tone is small, it is possible to calculate a gamma curve having such a characteristic as shown in FIG. 4 by using the measured gamma value on the intermediate tone side. Moreover, as shown in FIG. 5, by further adding a measured gamma value between the higher tone side and the intermediate tone side, it is possible to calculate a gamma curve in which parts on the higher tone side and the intermediate tone sides actually change toward a lower tone side as indicated by the dotted line.

In a case where the LUT preparing section 53 is configured by a logic circuit and the spline interpolation is used, a circuit configuration of the LUT preparing section 53 becomes complicated because a calculation throughput increases. On the other hand, the linear interpolation is an interpolation method in which a value between two points is obtained as a value on a straight line connecting two points. In the linear interpolation, a calculation throughput can be greatly reduced as compared with the spline interpolation which uses a multiple-order equation. Therefore, by using the linear interpolation, it is possible to simplify the circuit configuration of the LUT preparing section 53. Note, however, that, in the linear interpolation, three or more measured gamma values need to be used to ensure minimal accuracy.

As described above, the white gamma curve shown in, for example, FIG. 6 is calculated.

(Calculation of Three Primary Gamma Curves)

Next, a calculation of three primary gamma curves carried out in the step S4 (three primary gamma curve calculating step) will be described in detail.

Figure 7:
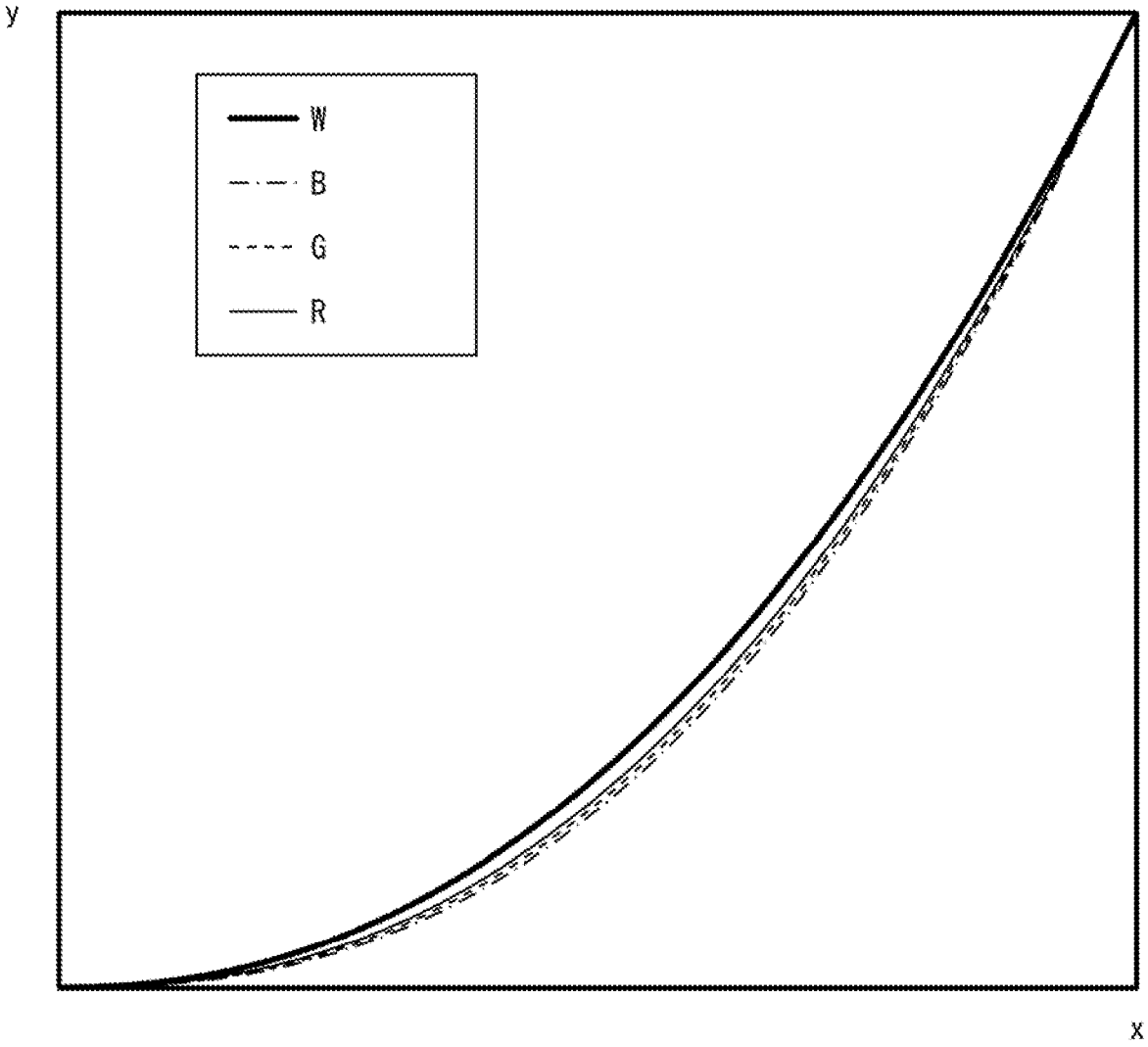
FIG. 7 is a view showing gamma curves of respective standard three primary colors of a liquid crystal display panel having an ideal γ characteristic.
Figure 8:
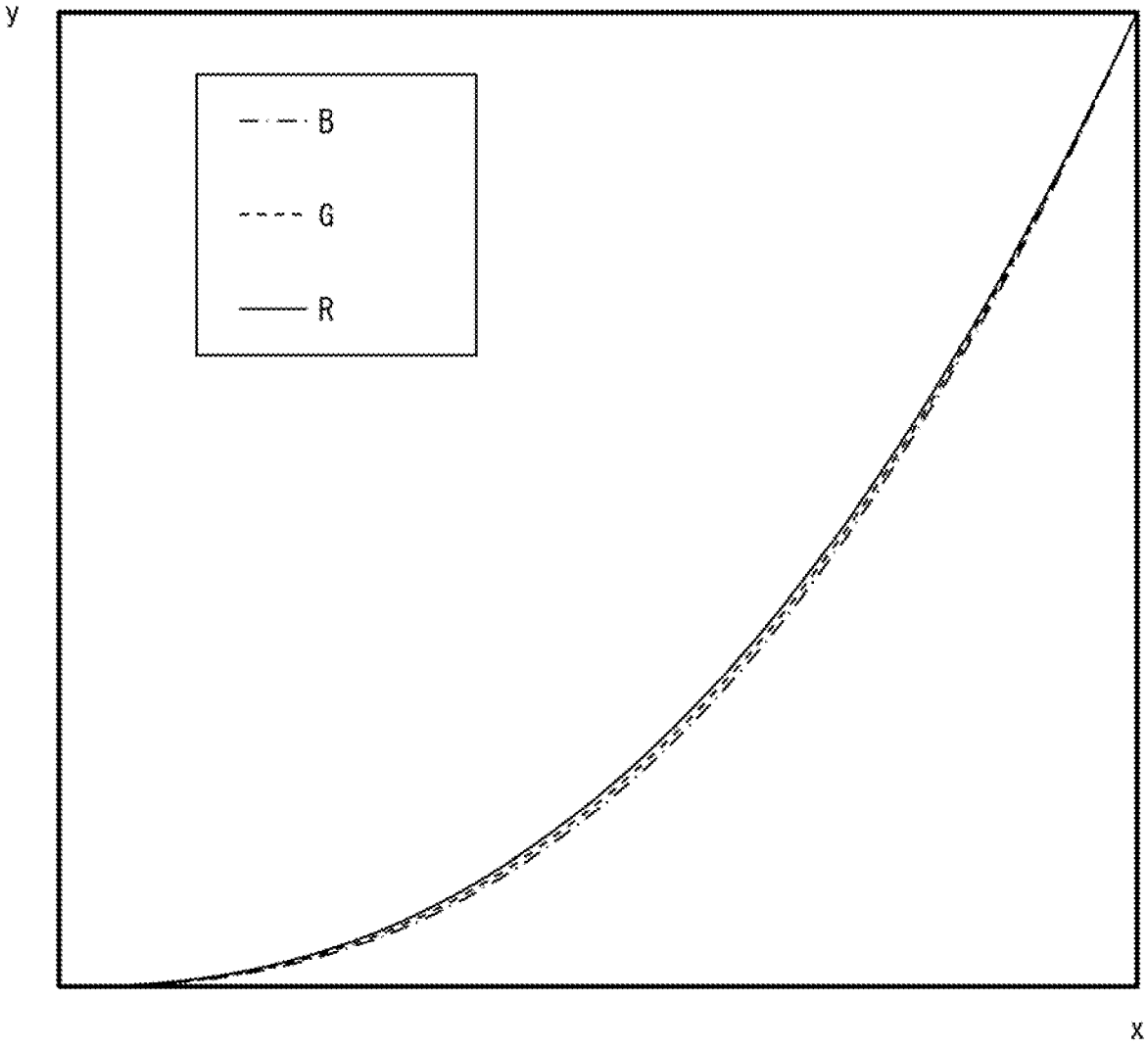
FIG. 8 is a view showing the three primary gamma curves of the liquid crystal display panel shown in FIG. 1 which are calculated based on the white gamma curve and the gamma curves of respective standard three primary colors.

FIG. 7 is a view showing gamma curves of respective standard three primary colors of the above described reference display panel. FIG. 8 is a view showing three primary gamma curves of the liquid crystal display panel 4 which are calculated based on a white gamma curve and gamma curves of respective standard three primary colors.

The three primary gamma curve calculating section 55 uses measured results of respective gamma curves of W, R, G, and B of the reference display panel in calculation of gamma curves of respective R, G, and B (see FIG. 7). In the reference display panel, as shown in FIG. 7, the gamma values of W, R, G, and B are approximately 2.2 at all tones. Differences or ratios of the respective R, G, and B gamma characteristics with respect to the gamma characteristic of W are stored in advance in a memory area including the data memory 51 of the driver 3 or in a memory area provided in the control device 2. Each of these differences or ratios is obtained in advance as a difference or a ratio of an output luminance y ($y=x^{\gamma}$) with respect to an inputted tone value x on each of the gamma curves, and the differences or ratios can be used among a plurality of liquid crystal display devices 100.

The three primary gamma curve calculating section 55 adds the above difference (for the same inputted tone value) or multiplies the above ratio (for the same inputted tone value) to an output luminance value with respect to each of inputted tone values of the white gamma curve (see FIG. 6) calculated by the white gamma curve calculating section 54. The three primary gamma curve calculating section 55 carries out the above arithmetical operation on the differences or ratios of R, G, and B so as to calculate the gamma curves of R, G, and B relative to the calculated white gamma curve (see FIG. 8).

(Calculation of Conversion Value)

Further, the following description will discuss details of calculation of a conversion value carried out in the step S5 (conversion value calculating step).

Figure 9:
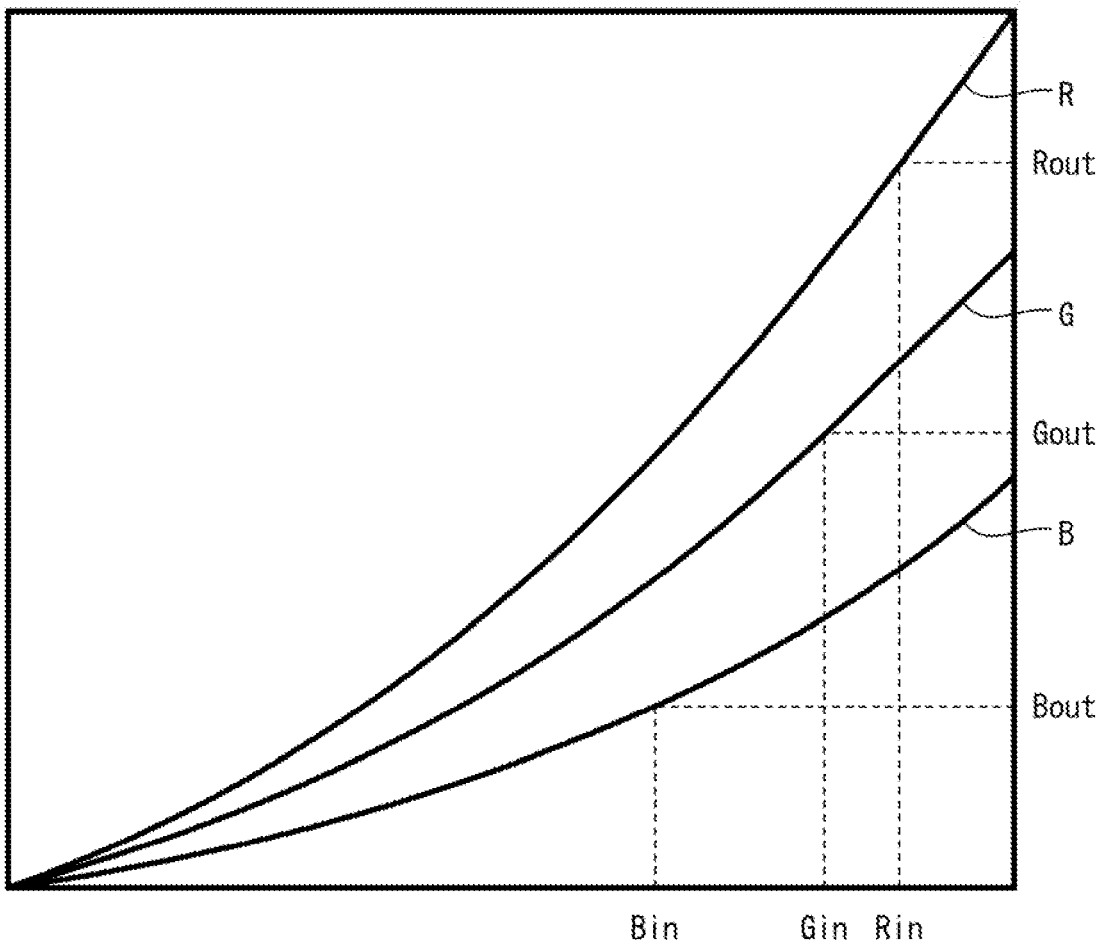
FIG. 9 is a view showing a relation between an expected output value and an expected input value of each of the three primary colors on a corresponding one of the gamma curves of the respective three primary colors.
Figure 10:
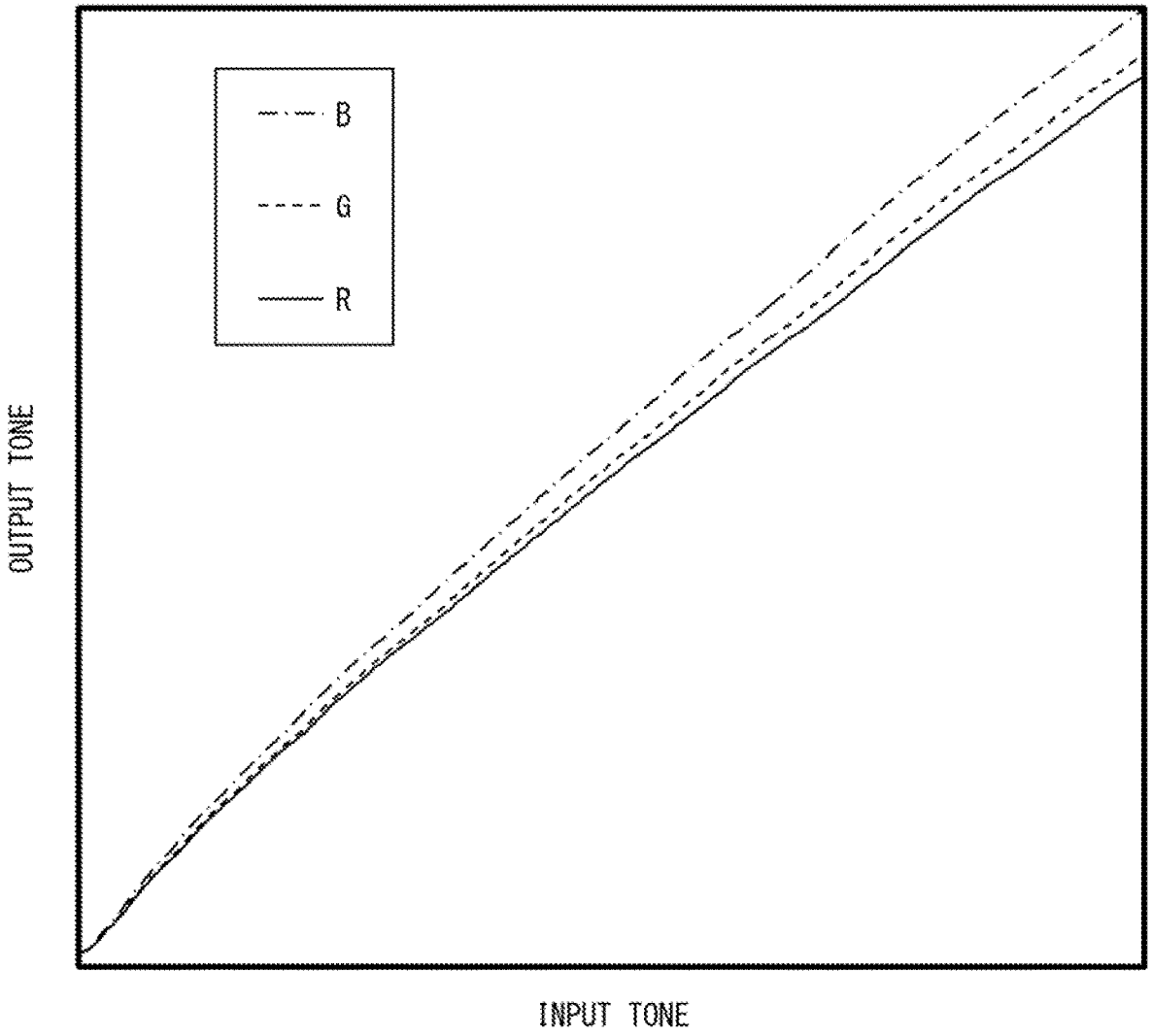
FIG. 10 is a view showing a LUT prepared based on calculated conversion values.

FIG. 9 is a view showing a relation between an expected output value and an expected input value of each of the three primary colors on a corresponding one of the gamma curves of the respective three primary colors. FIG. 10 is a view showing a LUT prepared based on calculated conversion values.

The conversion value calculating section 56 first calculates expected output values Rout, Gout, and Bout of R, G, and B in calculation of conversion values. The conversion value calculating section 56 calculates the expected output values Rout, Gout, and Bout by Formula (1) based on top coordinates for each of R, G, and B of the above described reference display panel and on top coordinates for W of the liquid crystal display panel 4.

[Math. 1]

$$\begin{bmatrix} Rout \\ Gout \\ Bout \end{bmatrix} = [M]^{-1} \begin{bmatrix} x \\ y \\ L \end{bmatrix} \quad (1)$$

In the above formula, M is a determinant representing top coordinates for R, G, and B of the reference display panel, and is expressed as coordinate values in an XYZ color space as in Formula (2) below. Each of x and y represents a chromaticity of W at the top coordinates for W of the liquid crystal display panel 4 based on the Lxy colorimetric system (xyY colorimetric system) of CIE. L represents a luminance of W at the top coordinates. x, y, and L are obtained from the white gamma curve which has been calculated by the white gamma curve calculating section 54 and represent coordinate values in the XYZ color space.

[Math. 2]

$$[M] = \begin{bmatrix} X_R & X_G & X_B \\ Y_R & Y_G & Y_B \\ Z_R & Z_G & Z_B \end{bmatrix} \quad (2)$$

The conversion value calculating section 56 uses a formula in which L in Formula (1) is replaced by L×Lv in order to normalize the above L (1 is the maximum value) and calculate luminance values of R, G, and B in 255 levels of tones. Lv is a correction value by which L is multiplied to obtain a curve of the power of 2.2 ($y=x^{2.2}$). The conversion value calculating section 56 calculates a value of luminance L that is a maximum luminance in a range in which Lv is changed from 0 to 1 in 255 steps, while maintaining the values of the expected output values Rout, Gout, and Bout that have been calculated with use of the above formula. Then, the conversion value calculating section 56 obtains values of the expected output values Rout, Gout, and Bout for each luminance L by gradually decreasing the luminance L from the calculated maximum value while maintaining the gamma value at 2.2 in the same formula. In general, a displayed video complies with the sRGB (standard color space) standard and a gamma value of the displayed video is 2.2. Therefore, it is necessary to maintain the gamma value at 2.2 in order to faithfully reproduce the displayed video.

Further, on the three primary gamma curves (see FIG. 9) calculated by the three primary gamma curve calculating section 55, the conversion value calculating section 56 obtains, by inverse calculation, expected input values Rin, Gin, and Bin corresponding to the respective values of expected output values Rout, Gout, and Bout obtained as described above. The expected input values Rin, Gin, and Bin thus obtained serve as the conversion values.

In the conversion process section 6, a LUT as shown in FIG. 10 is prepared by associating the conversion values (output tones) with input tones (0 to 255).

The calculation process carried out by the conversion process section 6 for obtaining the conversion values is not limited to the above example. For example, the conversion process section 6 can carry out a calculation process disclosed in Patent Literature 1 (paragraphs 0019 through 0032) as the calculation process for obtaining conversion values.

(Effects of Embodiment)

In the liquid crystal display device 100 in accordance with Embodiment 1, the driver 3 includes the tone correction data preparing section 5.

This allows white balance of display data to be corrected based on a smaller number of measured values. Therefore, it is possible to reduce a memory area for storing measured values and reduce an arithmetic process throughput for preparing a LUT. Thus, the driver 3 can have a tone correction data preparing function.

Moreover, the sequential processes from the preparation of the tone correction data to the tone correction of the display data are completed in the driver 3. Therefore, by using the liquid crystal display module 1 with the driver 3 is obtained, the corrected display data can be outputted only by inputting the display data from the control device 2.

In Embodiment 1 and Embodiment 2 (described later), a configuration including the liquid crystal display panel 4 as a display panel is described. However, the display panel is not limited to the liquid crystal display panel 4, and it is possible to employ an electroluminescence (EL) panel or the like.

[Embodiment 21]

Embodiment 2 of the present invention is described below with reference to FIG. 11. In Embodiment 2, the same reference numerals are assigned to constituent elements having the same functions as the constituent elements in Embodiment 1, and descriptions of such constituent elements are omitted.

Figure 11:
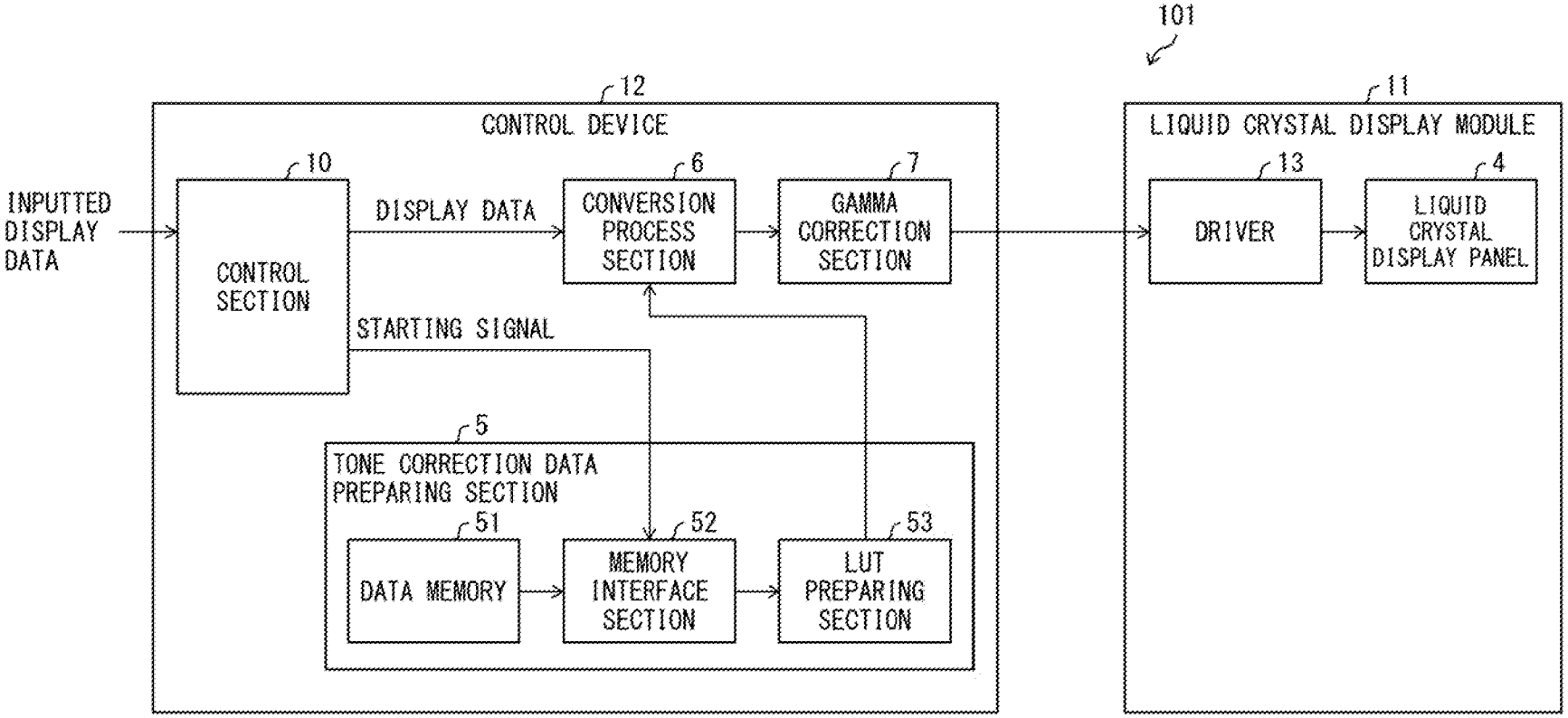
FIG. 11 is a block diagram showing a configuration of a liquid crystal display device in accordance with Embodiment 2 of the present invention.

FIG. 11 is a block diagram illustrating a configuration of a liquid crystal display device 101 in accordance with Embodiment 2.

As illustrated in FIG. 11, the liquid crystal display device 101 includes a liquid crystal display module 11 and a control device 12 (tone correction device).

The liquid crystal display module 11 is a part serving as a display unit in the liquid crystal display device 101, and includes a liquid crystal display panel 4 and a driver 13. The liquid crystal display module 11 can further include a backlight (not illustrated).

The control device 12 includes a tone correction data preparing section 5, a conversion process section 6, a gamma correction section 7, and a control section 10.

The control section 10 outputs display data, a control signal, and a starting signal (which are outputted by the control device 2 in Embodiment 1). The starting signal is supplied to the driver 13.

Unlike the driver 3 in Embodiment 1, the driver 13 does not include the tone correction data preparing section 5, the conversion process section 6, and the gamma correction section 7 but includes an output control circuit 8 and a timing controller 9 (which are not illustrated).

In the liquid crystal display device 101 configured as described above, the tone correction data preparing section 5 is provided in the control device 12. According to this configuration, an arithmetic process throughput for preparing a LUT in the control device 12 can be reduced. Therefore, in the control device 12, a working memory area for the arithmetic processing can be greatly reduced. From this, a load on the control device 12 can be reduced.

[Embodiment 3]

Embodiment 3 of the present invention is described below with reference to FIG. 12. In Embodiment 3, the same reference numerals are assigned to constituent elements having the same functions as the constituent elements in Embodiments 1 and 2, and descriptions of such constituent elements are omitted.

Figure 12:
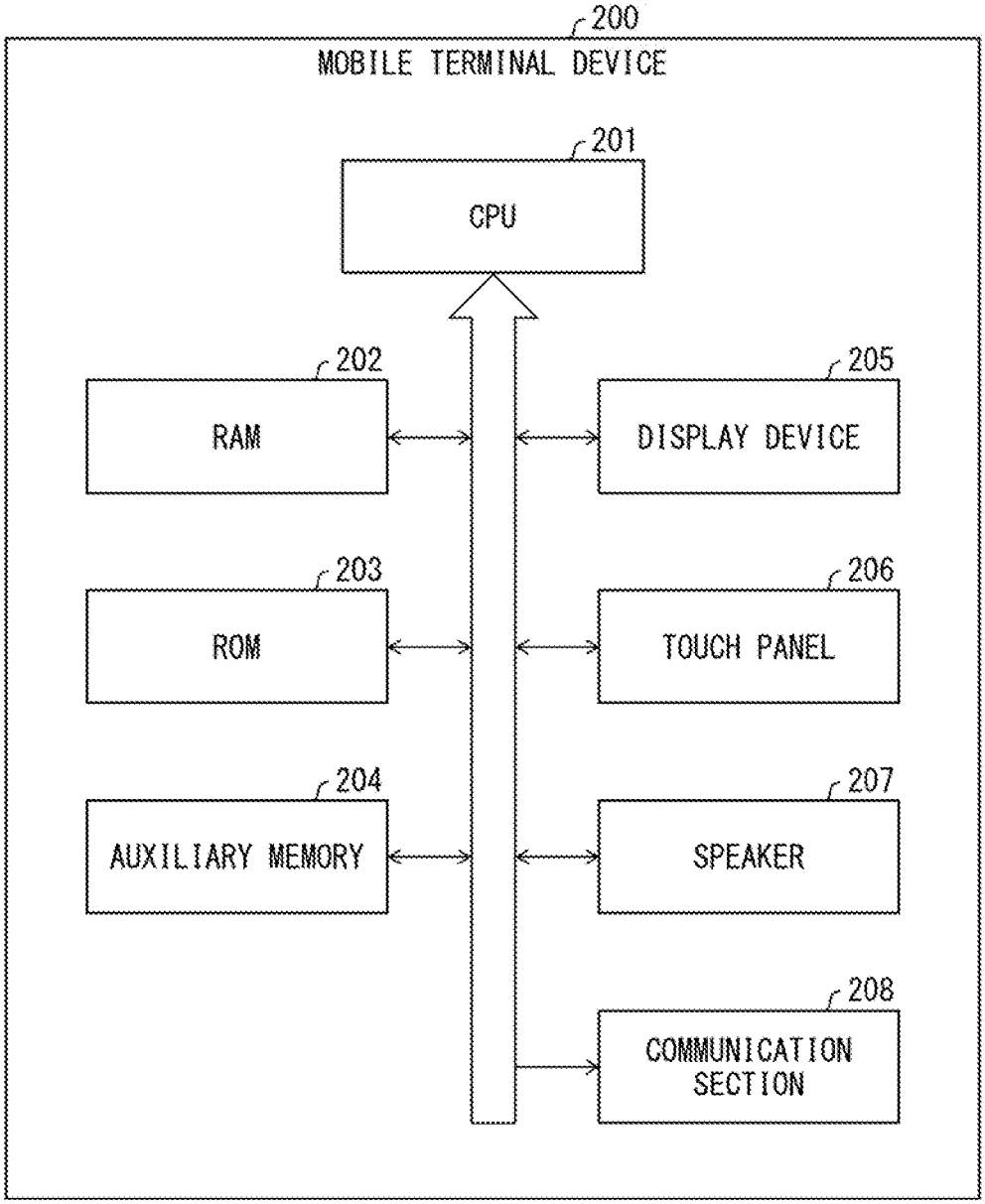
FIG. 12 is a block diagram showing a configuration of a mobile terminal device in accordance with Embodiment 3 of the present invention.

FIG. 12 is a block diagram indicating a hardware configuration of a mobile terminal device 200.

The mobile terminal device 200 (electronic apparatus) is a communication terminal device in which a dedicated operating system (OS) is mounted, and has an environment for executing an application program as follows.

As illustrated in FIG. 12, the mobile terminal device 200 includes a central processing unit (CPU) 201, a random access memory (RAM) 202, a read only memory (ROM) 203, an auxiliary memory 204, a display device 205, a touch panel 206, a speaker 207, and a communication section 208.

The CPU 201 is a processing device for executing a system program of the mobile terminal device 200. Specifically, when executing the system program, the CPU 201 receives data from the RAM 202, the auxiliary memory 204, the touch panel 206, and/or the like, and outputs a result of arithmetical operation or processing on the data to the RAM 202, the auxiliary memory 204, the display device 205, and/or the like.

The RAM 202 is a memory constituting a main storage device in the mobile terminal device 200, and is configured by a dynamic random access memory (DRAM) or the like.

The ROM 203 stores, as well as the system program, a program (such as a basic input output system (BIOS) which is executed when the mobile terminal device 200 is started or reset) which is essential for operation of the mobile terminal device 200.

The auxiliary memory 204 is provided for storing an application program. The auxiliary memory 204 is configured, for example, by a flash memory.

The display device 205 is provided for displaying a screen for realizing basic operations on the mobile terminal device 200, a screen displayed as a result of executing the application program, and the like. As the display device 205, the liquid crystal display device 100 of Embodiment 1 or the liquid crystal display device 101 of Embodiment 2 is used.

The touch panel 206 is provided on the display device 205. The touch panel 206 accepts a touch operation on the screen displayed on the display device 205, and outputs a touch operation signal as an input signal.

The speaker 207 is provided to output operation sound of the mobile terminal device 200, audio outputted as a result of executing the application program, and the like.

The communication section 208 is a part containing a communication circuit for carrying out communication via the Internet and communication via a mobile phone network.

As described above, the mobile terminal device 200 in accordance with Embodiment 3 includes the liquid crystal display device 100 or the liquid crystal display device 101 as the display device 205. The liquid crystal display devices 100 and 101 can be developed with a smaller burden, and this leads to a reduction in costs. As a result, a cost of the mobile terminal device 200 can be reduced.

[Recap]

The tone correction data preparation device in accordance with an aspect 1 of the present invention includes: a white gamma curve calculating section 54 which calculates a white gamma curve based on a deviation of a tone of white displayed on a display panel (liquid crystal display panel 4) with respect to a target tone value and on a measured gamma value, the tone including a maximum tone and being measured at one or more measurement points, the measured gamma value being measured at one or more measurement points which are at respective one or more arbitrary tones excluding a maximum tone in a white gamma characteristic of the display panel; a three primary gamma curve calculating section 55 which calculates three primary gamma curves of respective red, green, and blue by applying, to the white gamma curve, a relation obtained by comparing a gamma curve of white of a reference display panel having an ideal gamma characteristic with gamma curves of respective red, green, and blue of the reference display panel; and a conversion value calculating section 56 which calculates, based on expected output values of respective three primary colors and the three primary gamma curves, a conversion value for converting inputted display data into corrected display data in which a white balance has been corrected, the expected output values being calculated by the conversion value calculating section 56 based on highest tone values of respective three primary colors of the reference display panel and on a highest tone value of white of the display panel.

According to the configuration, it is possible to prepare a conversion value for correcting a tone based on a smaller number of measured values. Therefore, a load on arithmetic processing for preparing a LUT based on the conversion value is reduced. This greatly reduces a working memory area for the arithmetic processing in a control device in which the tone correction device outputs display data to the display driving circuit. Moreover, the tone correction data preparation device can be incorporated into the display driving circuit.

According to the tone correction data preparation device in accordance with an aspect 2 of the present invention, it is possible in the aspect 1 that the white gamma curve calculating section 54 calculates the white gamma curve with use of the measured gamma value on a higher tone side.

According to the configuration, since a deviation of tone with respect to a target value is more noticeable (i.e., tone correction is easier) in the color on the higher tone side, it is possible to carry out correction in which the corrected deviation is hardly noticeable.

The tone correction device in accordance with an aspect 3 of the present invention can include the tone correction data preparation device (tone correction data preparing section 5) of the aspect 1 or 2; a conversion process section 6 which converts the inputted display data into the corrected display data based on the conversion value; and a gamma correction section 7 which corrects the corrected display data with a predetermined gamma characteristic.

According to the configuration, it is possible to supply, to the display panel, the display data in which the gamma correction has been applied to the corrected display data whose white balance has been corrected.

According to the tone correction device in accordance with an aspect 4 of the present invention, it is possible in the aspect 3 that the tone correction device is provided in a display driving circuit which supplies, to the display panel, output display data which has been subjected to gamma correction by the gamma correction section 7.

According to the configuration, since the tone correction device is provided in the display driving circuit, there is no need for the tone correction device to be provided in a control device which outputs the display data to the display driving circuit. This makes it possible to not only reduce a burden of developing the control device but also eliminate the need to change the tone correction data preparation device in the control device when the display panel is changed.

According to the tone correction device in accordance with an aspect 5 of the present invention, it is possible in the aspect 3 that the tone correction device controls a display driving circuit which supplies, to the display panel, output display data which has been subjected to gamma correction by the gamma correction section 7; and the tone correction device is provided in a control device which outputs the inputted display data.

According to the configuration, since the tone correction device is provided in the control device, it is possible to greatly reduce a working memory area for the arithmetic processing in the control device.

The electronic apparatus in accordance with an aspect 6 of the present invention can include the tone correction device (driver 3 or control device 12) of the above aspect 3 or 4 and the display panel.

According to the configuration, the cost of the tone correction device is reduced because the development burden is small. As a result, the cost of the electronic apparatus on which the tone correction device is mounted can be reduced.

The method in accordance with an aspect 7 of the present invention for preparing tone correction data includes the steps of: calculating a white gamma curve based on a deviation of a tone of white displayed on a display panel with respect to a target tone value and on a measured gamma value, the tone including a maximum tone and being measured at one or more measurement points, the measured gamma value being measured at one or more measurement points which are at respective one or more arbitrary tones excluding a maximum tone in a white gamma characteristic of the display panel; calculating three primary gamma curves of respective red, green, and blue based on a relation obtained by comparing gamma curves of respective red, green, and blue of a reference display panel having an ideal gamma characteristic with the white gamma curve; and calculating, based on expected output values of respective three primary colors and the three primary gamma curves, a conversion value for converting inputted display data into corrected display data in which a white balance has been corrected, the expected output values being calculated based on highest tone values of respective three primary colors of the reference display panel and on a highest tone value of white of the display panel.

According to the configuration, it is possible to prepare a conversion value for correcting a tone based on a smaller number of measured values, as with the tone correction data preparation device in accordance with the aspect 1. Therefore, a load on arithmetic processing for preparing a LUT based on the conversion value is reduced.

[Additional Remarks]

The present invention is not limited to the Embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

REFERENCE SIGNS LIST

2: Control device (tone correction device)
3: Driver (tone correction device, display driving circuit)
4: Liquid crystal display panel (display panel)
5: Tone correction data preparing section (tone correction data preparation device)
6: Conversion process section
7: Gamma correction section
54: White gamma curve calculating section
55: Three primary gamma curve calculating section
100, 101: Liquid crystal display device (display device)
200: Mobile terminal device (electronic apparatus)

The invention claimed is:

1. A tone correction data preparation device comprising:

a white gamma curve calculating section which calculates a white gamma curve based on a deviation of a measured value with respect to a target tone value and on a measured gamma value, the measured value being an initial value in a state in which white is monochromatically displayed on a display panel, the target tone value being a target tone value of a tone including a maximum tone measured at one or more measurement points of white displayed on the display panel, the measured gamma value being measured at one or more measurement points which are at respective one or more arbitrary tones excluding a maximum tone in a white gamma characteristic of the display panel;

a three primary gamma curve calculating section which calculates three primary gamma curves of respective red, green, and blue by applying, to the white gamma curve, a relation obtained by comparing a gamma curve of white of a reference display panel having an ideal gamma characteristic with gamma curves of respective red, green, and blue of the reference display panel; and a conversion value calculating section which calculates, based on expected output values of respective three primary colors and the three primary gamma curves, a conversion value for converting inputted display data into corrected display data in which a white balance has been corrected, the expected output values being calculated by the conversion value calculating section based on highest tone values of respective three primary colors of the reference display panel and on a highest tone value of white of the display panel, wherein the white gamma curve calculating section calculates top coordinates, which are represented by tone values of three primary colors of maximum tone values on the white gamma curve, by adding the deviation to the measured value, calculates the white gamma curve in the vicinity of the top coordinates with use of an auxiliary deviation with respect to an auxiliary target tone value at a tone which is slightly lower than the top coordinates, and calculates a part other than the top coordinates on the white gamma curve based on measured gamma values.

2. The tone correction data preparation device as set forth in claim 1, wherein:

the white gamma curve calculating section calculates the white gamma curve with use of the measured gamma value on a higher tone side.

3. A tone correction device comprising:

a tone correction data preparation device recited in claim 1;

a conversion process section which converts the inputted display data into the corrected display data based on the conversion value; and a gamma correction section which corrects the corrected display data with a predetermined gamma characteristic.

4. The tone correction device as set forth in claim 3, wherein:

said tone correction device is provided in a display driving circuit which supplies, to the display panel, output display data which has been subjected to gamma correction by the gamma correction section.

5. The tone correction device as set forth in claim 3, wherein:

said tone correction device controls a display driving circuit which supplies, to the display panel, output display data which has been subjected to gamma correction by the gamma correction section; and said tone correction device is provided in a control device which outputs the inputted display data.

6. An electronic apparatus comprising:

a tone correction device recited in claim 3; and the display panel.

7. A method for preparing tone correction data, said method comprising the steps of:

calculating a white gamma curve based on a deviation of a measured value with respect to a target tone value and on a measured gamma value, the measured value being an initial value in a state in which white is monochromatically displayed on a display panel, the target tone value being a target tone value of a tone including a maximum tone measured at one or more measurement points of white displayed on the display panel, the measured gamma value being measured at one or more measurement points which are at respective one or more arbitrary tones excluding a maximum tone in a white gamma characteristic of the display panel;

calculating three primary gamma curves of respective red, green, and blue based on a relation obtained by comparing gamma curves of respective red, green, and blue of a reference display panel having an ideal gamma characteristic with the white gamma curve; and calculating, based on expected output values of respective three primary colors and the three primary gamma curves, a conversion value for converting inputted display data into corrected display data in which a white balance has been corrected, the expected output values being calculated based on highest tone values of respective three primary colors of the reference display panel and on a highest tone value of white of the display panel, wherein top coordinates, which are represented by tone values of three primary colors of maximum tone values on the white gamma curve, are calculated by adding the deviation to the measured value, the white gamma curve in the vicinity of the top coordinates is calculated with use of an auxiliary deviation with respect to an auxiliary target tone value at a tone which is slightly lower than the top coordinates, and a part other than the top coordinates on the white gamma curve is calculated based on measured gamma values.

* * * * *